US010507853B2

(12) United States Patent
Kaede et al.

(10) Patent No.: US 10,507,853 B2
(45) Date of Patent: Dec. 17, 2019

(54) TRAIN-INFORMATION MANAGEMENT DEVICE AND TRAIN-INFORMATION MANAGEMENT METHOD

(71) Applicant: MITSUBISHI ELECTRIC CORPORATION, Chiyoda-ku, Tokyo (JP)

(72) Inventors: Satoshi Kaede, Tokyo (JP); Takashi Miyauchi, Tokyo (JP); Masahiro Chikamori, Tokyo (JP); Shingo Hamada, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 104 days.

(21) Appl. No.: 15/537,308

(22) PCT Filed: Jan. 27, 2015

(86) PCT No.: PCT/JP2015/052216
§ 371 (c)(1),
(2) Date: Jun. 16, 2017

(87) PCT Pub. No.: WO2016/121003
PCT Pub. Date: Aug. 4, 2016

(65) Prior Publication Data

US 2018/0001917 A1 Jan. 4, 2018

(51) Int. Cl.
*B61L 25/02* (2006.01)
*B61L 25/04* (2006.01)

(52) U.S. Cl.
CPC ..... *B61L 25/026* (2013.01); *B61L 25/04* (2013.01); *B61L 2205/00* (2013.01)

(58) Field of Classification Search
CPC ..... B61L 25/026; B61L 25/04; B61L 2205/00
See application file for complete search history.

(56) References Cited

U.S. PATENT DOCUMENTS 3,268,727 A * 8/1966 Shepard ..... B61L 3/125 246/122 R
4,284,028 A * 8/1981 Swanburg ..... G01P 1/04 116/62.2

(Continued)

FOREIGN PATENT DOCUMENTS

EP 1 547 899 A2 6/2005
JP 59-136001 A 8/1984

(Continued)

OTHER PUBLICATIONS

International Search Report (PCT/ISA/210) dated Mar. 31, 2015, by the Japanese Patent Office as the International Searching Authority for International Application No. PCT/JP2015/052216.

(Continued)

*Primary Examiner* — Calvin Cheung
(74) *Attorney, Agent, or Firm* — Buchanan Ingersoll & Rooney PC

(57) ABSTRACT

A train-information management device mounted on a train, includes: an intra-block position calculator to convert information on a kilometrage that indicates a position of the train into information on a block number and an intra-block position of a plurality of blocks into which a route of the train is divided and that are used when a train position is specified by a train radio system; and an on-board router to communicate the information on the block number and the intra-block position to a ground side by using a system that is different from a system that is used for communication between the ground side and a train side via a radio base station in the train radio system.

12 Claims, 9 Drawing Sheets

(56) References Cited

U.S. PATENT DOCUMENTS 4,361,301 A * 11/1982 Rush ..... B61L 1/18 104/298
5,420,883 A * 5/1995 Swensen ..... B61L 3/125 342/450
5,696,704 A * 12/1997 Semrau ..... G01D 3/024 324/166
6,218,961 B1 * 4/2001 Gross ..... B60T 7/22 246/122 R
7,731,129 B2 * 6/2010 Stull ..... B61L 27/0005 246/167 R
8,660,787 B2 * 2/2014 Minami ..... G01C 21/3484 340/988
8,798,902 B2 * 8/2014 Kumar ..... B60L 3/12 701/417
2003/0025043 A1 * 2/2003 Fierz ..... B61L 21/06 246/3
2003/0093195 A1 * 5/2003 Ishikawa ..... B61L 3/125 701/19
2004/0030466 A1 * 2/2004 Rezk ..... B61L 15/0045 701/19
2005/0107954 A1 * 5/2005 Nahla ..... B61L 25/021 701/301
2005/0133673 A1 6/2005 Sugita et al.
2005/0192720 A1 * 9/2005 Christie ..... B61L 25/025 701/19
2006/0074544 A1 * 4/2006 Morariu ..... B61L 27/0027 701/117
2008/0231506 A1 * 9/2008 Stull ..... B61L 3/125 342/357.33
2009/0230254 A1 * 9/2009 Daum ..... B61L 3/125 246/27
2010/0262321 A1 * 10/2010 Daum ..... B61L 3/006 701/20
2010/0299007 A1 * 11/2010 Ghaly ..... B61L 3/008 701/20
2013/0116864 A1 * 5/2013 Tokumaru ..... B61L 15/0027 701/19
2014/0103166 A1 * 4/2014 Asuka ..... B61L 23/24 246/4
2014/0131524 A1 * 5/2014 Grimm ..... B61L 27/00 246/3
2014/0200741 A1 * 7/2014 Kanner ..... G06F 17/00 701/2
2014/0326835 A1 * 11/2014 Schwellnus ..... B61L 25/02 246/122 R
2014/0358435 A1 * 12/2014 Bell ..... G01C 21/3492 701/527
2015/0009331 A1 * 1/2015 Venkatraman ..... B61L 23/041 348/148
2015/0232110 A1 * 8/2015 Ghaly ..... B61L 27/0055 246/62

FOREIGN PATENT DOCUMENTS

JP 01-194526 A 8/1989
JP 09-156505 A 6/1997
JP 2000-004501 A 1/2000
JP 2005-178667 A 7/2005
JP 2013-241101 A 12/2013
JP 2013-244758 A 12/2013
JP 2013244758 A * 12/2013 ..... B61L 25/02
JP 2014-046818 A 3/2014
JP 2014-083901 A 5/2014

OTHER PUBLICATIONS

Written Opinion (PCT/ISA/237) dated Mar. 31, 2015, by the Japanese Patent Office as the International Searching Authority for International Application No. PCT/JP2015/052216.
Extended European Search Report dated Jul. 20, 2018, issued by the European Patent Office in corresponding European Application No. 15879900.7. (10 pages).
Pellegrin J et, al., "D'Astree a ETCS Ou Dix Ans De Recherche Sur La Future Signalisation Ferroviaire Europeenne", Revue Générale Des Chemins De Fer : RCGF, HC Éditions, FR, Nov. 1, 1995, vol. 114, No. 11, pp. 13-55, XP000535266.

* cited by examiner

TRAIN-INFORMATION MANAGEMENT DEVICE AND TRAIN-INFORMATION MANAGEMENT METHOD

FIELD

The present invention relates to a train-information management device that is included in a train radio system and is mounted on a train and to a train-information management method.

BACKGROUND

In conventional train radio systems, an on-board control device in a train detects the position of the train and the train position information is transmitted to the train-presence management device on the ground via a train control radio base station. The system on the ground side uses the train position information on each train to calculate the stop limit position, and the like for each train and transmits the calculated results to the trains via the train control radio base station, thereby managing the operations of each train. Such a technology is disclosed in Patent Literature 1 described below.

CITATION LIST

Patent Literature

Patent Literature 1: Japanese Patent Application Laid-open No. 2014-46818

SUMMARY

Technical Problem

With the above conventional technology, however, when a failure occurs in a device in the train radio system in the train, the on-board control device may not be able to detect the position of the train itself or it may not be possible for the train position information to be transmitted to the train-presence management device via the train control radio base station. In such a case, a problem arises in that it may not be possible to determine, on the ground side, the position of the train in which the device failure has occurred and there is a risk of the operations of other trains that are running normally being affected. The train radio system can make a backup of a train position by using ID pickup coils, ID detection ground coils, and a base device, with the accuracy depending on the intervals at which the ID detection ground coils are disposed. This however has a problem in that it necessitates the installation of ID pickup coils in the train and ID detection ground coils on the ground.

The present invention has been achieved in view of the above and an object of the present invention is to provide a train-information management device with a simple configuration that can obtain a train position and transmit train position information to the ground side.

Solution to Problem

In order to solve the above problems and achieve the object, an aspect of the present invention is a train-information, management device mounted on a train. The train-information management device includes an intra-block position calculator to convert information on a kilometrage that indicates a position of the train into information on a block number and an intra-block position of a plurality of blocks into which a route of the train is divided, and that are used when a train position is specified by a train radio system. Moreover, the train-information management device includes a communication device to communicate the information on the block number and the intra-block position to a ground side by using a system that is different from a system chat is used for communication between the ground side and a train side via a radio base station in the train radio system.

Advantageous Effects of Invention

According to the present invention, an effect is obtained where the train position can be obtained and the train position information can be transmitted to the ground side by using a simple configuration.

DESCRIPTION OF EMBODIMENTS

A train-information management device and a train-information management method according to an embodiment of the present invention will be explained below in detail with reference to the drawings. This invention is not limited to the embodiment.

Embodiment

Figure 1:
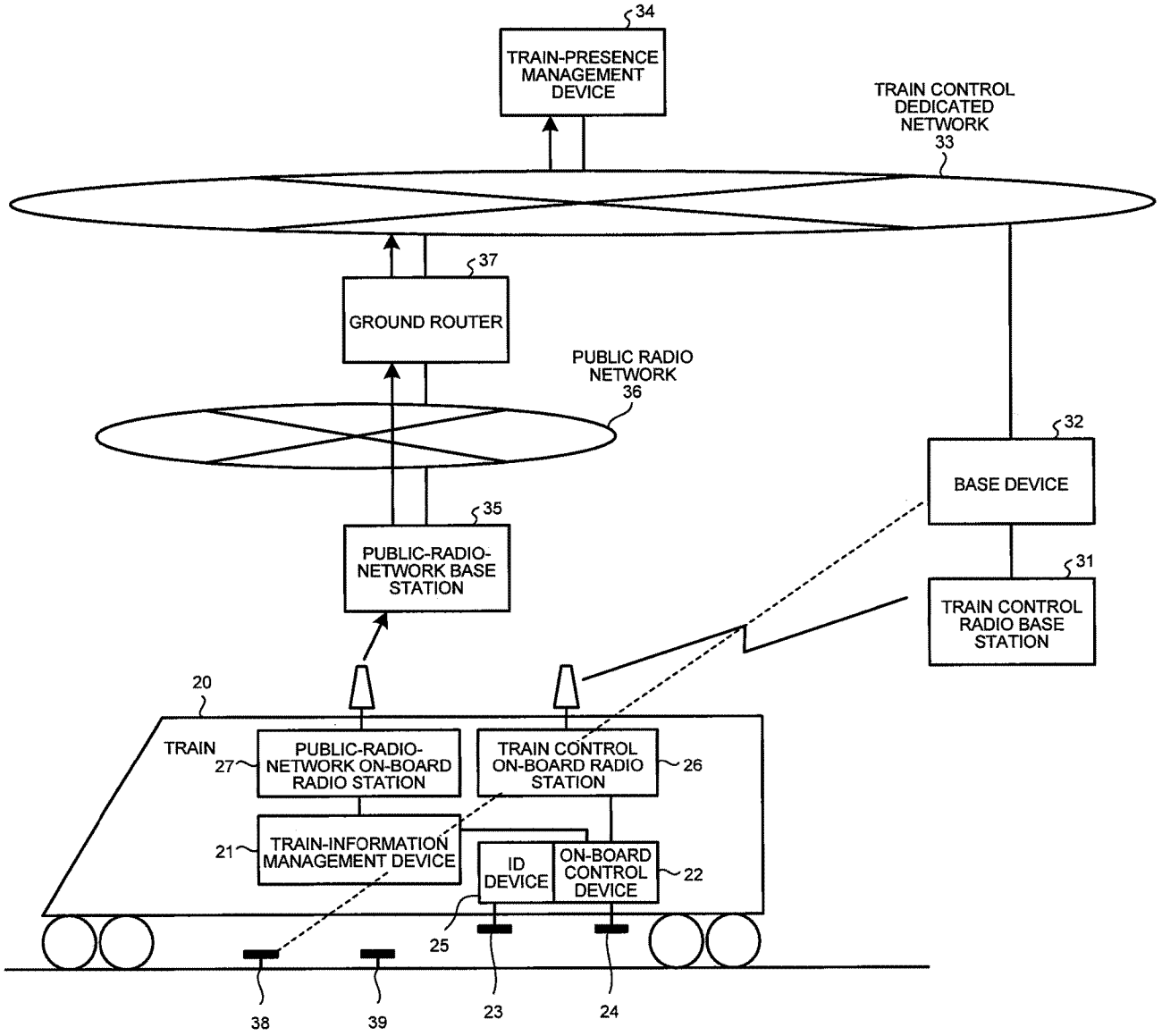
FIG. 1 is a diagram illustrating an example configuration of a train radio system that includes a train on which a train-information management device is mounted.

FIG. 1 is a diagram illustrating an example configuration of a train radio system that includes a train 20 on which a train-information management, device 21 according to an embodiment of the present invention is mounted. A conventional train radio system is configured such that an on-board control device 22 obtains the train position on the basis of the running distance of the train 20, corrects the train position by using a position correction pickup coil 24 and a position correction ground coil 39, and transmits, to a train-presence management device 34, train position information from a train control on-board radio station 26 connected to the on-board control device 22 via a train control radio base station 31, a base device 32, and a train control dedicated network 33.

When the train control on-board radio station 26 connected to the on-board control device 22 or the train control radio base station 31 fails, the train 20 cannot transmit train position information to the train-presence management device 34. In such a case, the train-presence management device 34 can use, as a backup system, an ID device 25, an ID pickup coil 23, ID detection ground coils 38, and the base device 32 to specify the position of the train 20 with the accuracy depending on the intervals at which the ID detection ground coils 38 are disposed. When the train control on-board radio station 26 or the on-board control, device 22 of the train 20 as well as its redundant system fail or the train control radio base station 31 as well as its redundant system fail, the train-presence management device 34 cannot specify the position of the train 20. Moreover, when the ID device 25 or the ID pickup coil 23 fails, the train-presence management device 34 cannot specify the positon of the train 20 even by using a backup system.

In the present embodiment, the train-information management device 21 of the train 20 obtains the position of the train 20 independently from the on board control device 22, connects itself to the train control dedicated network 33 and the train-presence management device 34 via a public-radio-network on-board radio station 27, a public-radio-network base station 35, a public radio network 36, and a ground router 37, and then transmits train position information to the train-presence management device 34. The public-radio-network base station 35, the public radio network 36, and the ground router 37 are existing facilities already installed on the ground side and the public-radio-network on-board radio station 27 is existing facilities already installed in the train 20; therefore, with the train radio system, mounting the train-information management device 21 on the train 20 enables train position information to be transmitted to the train-presence management device 34 over the public radio network 36.

Figure 2:
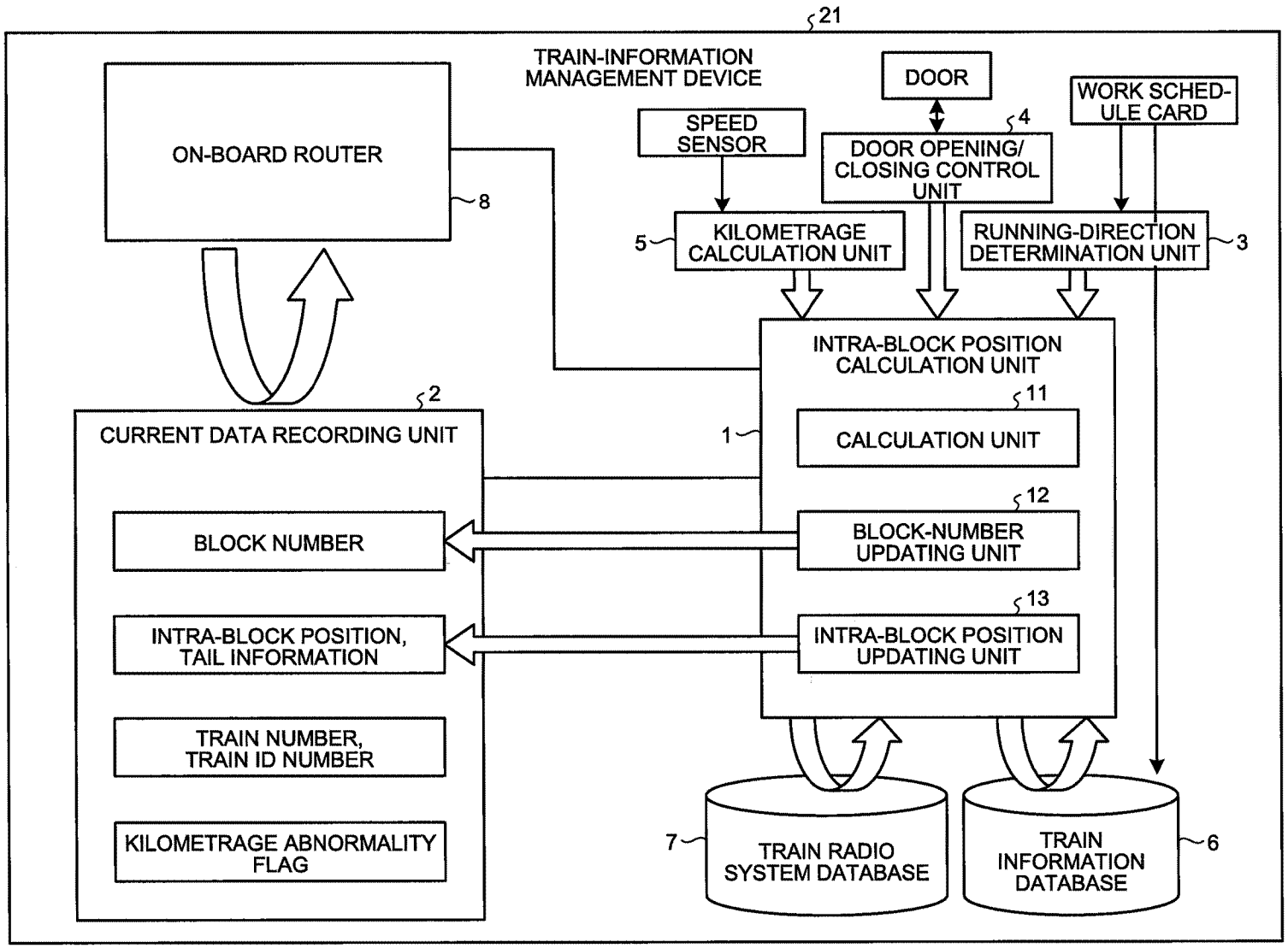
FIG. 2 is a block diagram illustrating an example configuration of the train-information management device.

Next, the configuration of the train-information management device 21 will be described. FIG. 2 is a block diagram illustrating an example configuration of the train-information management device 21 according to the embodiment of the present invention. The train-information management device 21 is configured such that it is independent from the on-board control device 22 of the conventional train radio system. The train-information management device 21 includes an intra-block position calculation unit (intra-block position calculator) 1, which obtains, by calculation and as a position of the train 20, the block number and the intra-block position in the blocks into which the route of the train 20 is divided and that are used by the train radio system to specify the train position; a current data recording unit 2, which records train position information on the train 20 obtained by the intra-block position calculation unit 1; a running-direction determination unit 3, which is a card reader that reads the content of the work schedule card in which information on each operation of the train 20 is written; a door opening/closing control unit 4, which controls the opening and closing of the doors of the train 20 under the operation of the driver, conductor, or the like and determines the open/close status of the doors; a kilometrage calculation unit 5, which is connected to a speed sensor and calculates the kilometrage, which is the running distance of the train 20, by using, for example, information on the diameter and the rotation, speed of the wheels of the train 20; a train information database 6, in which information on the train 20 that is running is recorded; a train radio system database 7, in which information on the blocks in which the train 20 runs is recorded in order to specify the position of the train 20; and an on-board router 8, which is a communication device that transmits, via the public-radio-network on-board radio station 27 and then over the public radio network 36, the train position information obtained from the current data recording unit 2 to the train-presence management device 34 on the ground side.

The intra-block position calculation unit 1 includes a calculation unit 11, which obtains the block number and the intra-block position, which indicate the position of the train 20, by performing a calculation to convert information on the kilometrage from the kilometrage calculation unit 5 into information in the form of the block number and the intra-block position using information from the running-direction determination unit 3, the door opening/closing control unit 4, the kilometrage calculation unit 5, the train information database 6, and the train radio system database 7; a block-number updating unit 12, which uses information on the block number obtained by the calculation unit 11 to record the information on the block number in the current data recording unit 2 or update the information on the block number recorded in the current data recording unit 2; and an intra-block position updating unit 13, which uses information on the intra-block position obtained by the calculation unit 11 to record the information on the intra-block position in the current data recording unit 2 or update the information on the intra-block position recorded in the current data recording unit 2.

Figure 3:
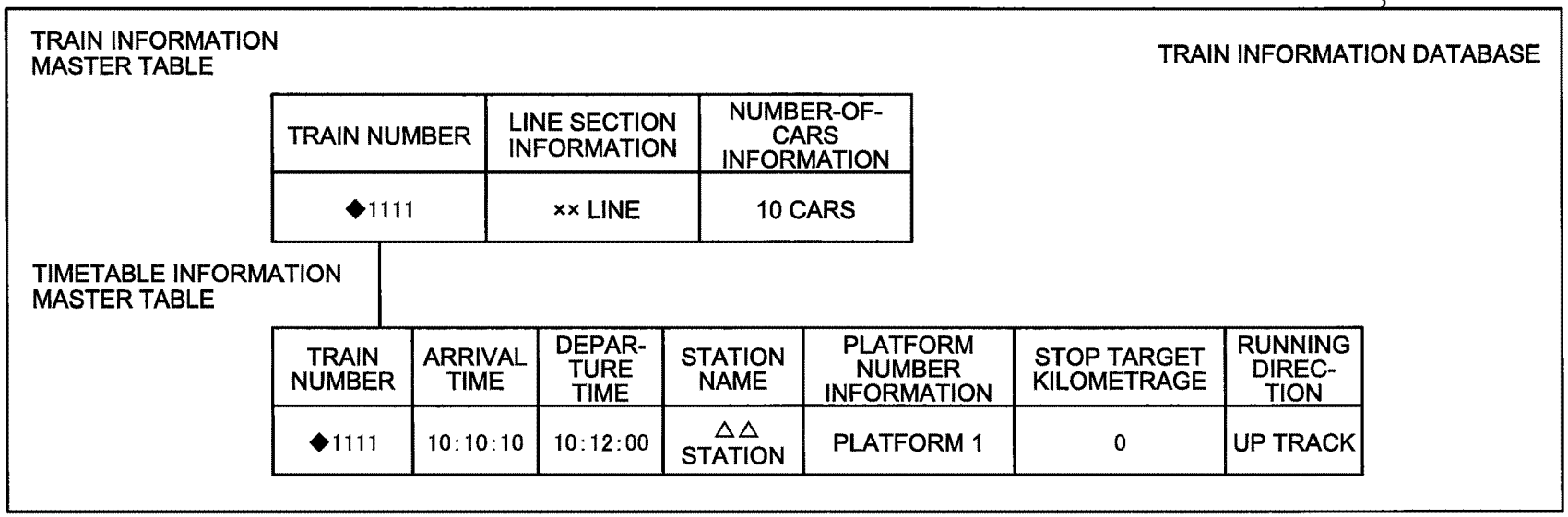
FIG. 3 is a diagram illustrating an example configuration of a train information database.

FIG. 3 is a diagram illustrating an example configuration of the train information database 6. The train information database 6 records therein information on the train that is running in the form of a train information master table and a timetable information master table.

The train information master table records therein various pieces of information that include the train number for identifying the train 20 that is running; line section information, which indicates the line on which the train 20 runs; and number-of-cars information, which indicates the makeup of the formation of the train 20. The train information database 6 records therein various pieces of information, such as the train number "◆111", the line section information "×× line", and the number-of-cars information "10 cars", in the form of the train information master table.

The timetable information master table records therein various pieces of information that include the train number; the arrival time and departure time of the train 20 at the station indicated by the station name, which will be described later; the station name of the station at which the train 20 stops; platform number information, which is information indicating the number of the platform at which the train 20 stops in the station indicated by the station name; the stop target kilometrage, which indicates, by kilometrage, the position at which the train 20 stops in the station; and the running direction, which indicates the running direction of the train 20. The train information database 6 records therein various pieces of information, such as the train number "◆1111", the arrival time "10:10:10", the departure time "10:12:00", the station name "ΔΔ station", the platform number information "platform 1", the stop target kilometrage "0", and the running direction "up track", in the form of the timetable information master table. Here, although a description is made of a case where the station name is "ΔΔ station", similar information is recorded in the timetable information master table for each station at which the train 20 stops.

Figure 4:
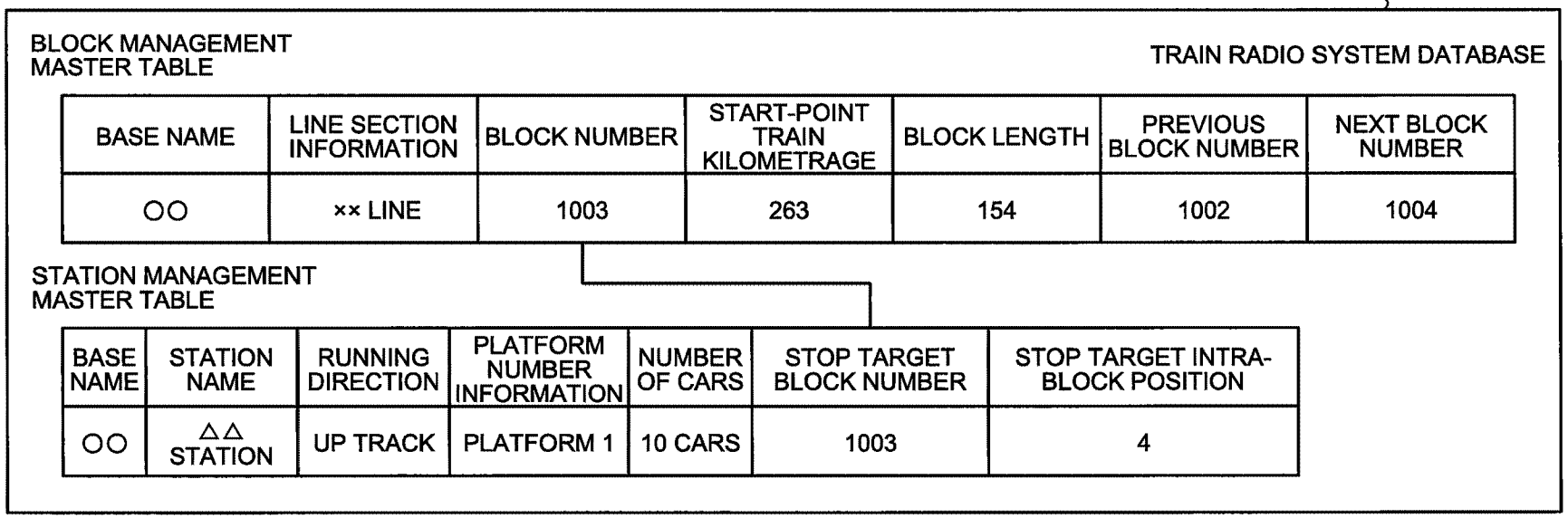
FIG. 4 is a diagram illustrating an example configuration of a train radio system database.

FIG. 4 is a diagram illustrating an example configuration of the train radio system database 7. The train radio system database 7 records therein information on the blocks in the form of a block management master table and a station management master table.

The block management master table records therein various pieces of information that include the base name, which indicates the base in an area where the block to be managed is present; line section information; the block, number, which indicates the block to be managed; the start-point train kilometrage, which indicates, by kilometrage, the start point that is the beginning of the block to be managed; the block length, which indicates the length of the block to be managed; the previous block number, which indicates the number given to the block in which the train 20 runs before the block to be managed; and the next block number, which indicates the number given to the block in which the train 20 runs next to the block to be managed. The train radio system database 7 records therein various pieces of information, such as the base name "○○", the line section information "×× line", the block number "1003", the start-point train kilometrage "263", the block length "154", the previous block number "1002", and the next block number "1004", in the form of the block management master table. Here, although a description is made of a case where the block number is "1003", similar information is recorded in the block management master table for each block.

The station management master table records therein various pieces of information, such as the base name; the station name; the running direction; platform number information, the number of cars; the stop target block number, which indicates the block in which the station indicated by the station name is present; and the stop target intra-block position, which indicates the position at which the train 20 stops in the station in the block indicated by the stop target block number. The train radio system database 7 records therein various pieces of information, such as the base name "○○", the station name "ΔΔ station", the running direction "up track", the platform number information "platform 1", the number of cars "10 cars", the stop target block number "1003", and the stop target intra-block position "4", in the form of the station management master table. Here, although a description, is made of a case where the station name is "ΔΔ station", similar information is recorded in the station management master table for each station.

The configurations of the train information database 6 and the train radio system database 7 are similar to those of a conventional train radio system. The information on the kilometrage and the blocks is recorded in meters in the train information database 6 and the train radio system database 7.

Figure 5:
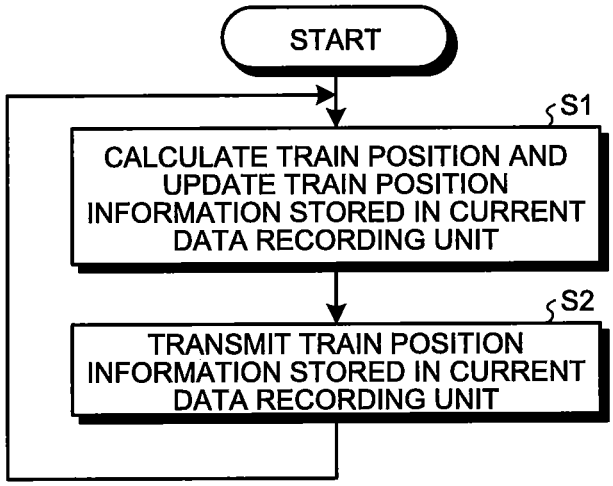
FIG. 5 is a flowchart illustrating the operation performed by the train-information management device.
Figure 6:
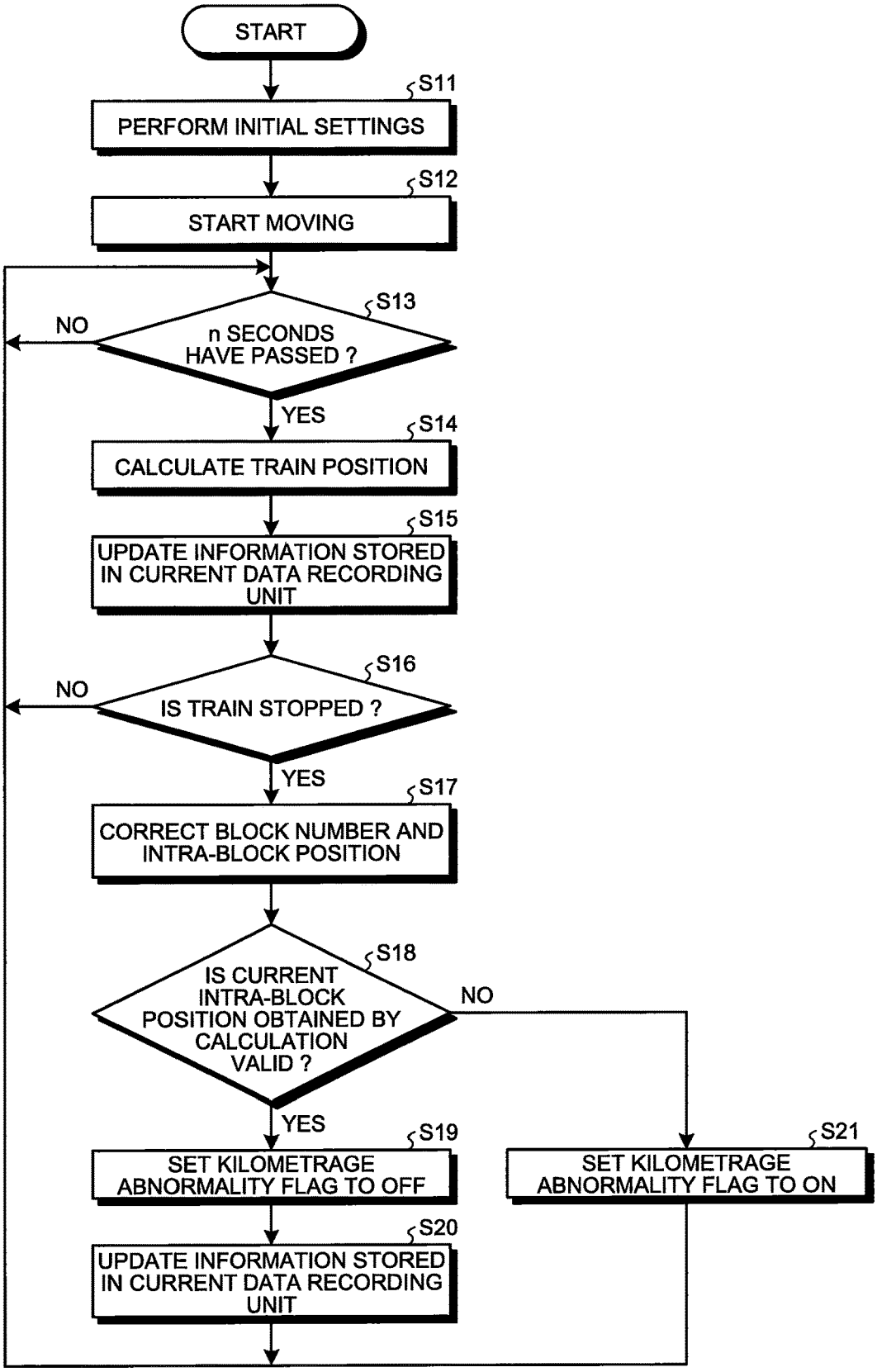
FIG. 6 is a flowchart illustrating the operation for obtaining, by calculation, the train position performed by the train-information management device.

Next, a description will be given of an operation for periodically obtaining, updating, and transmitting the train position performed by the train-information management device 21. FIG. 5 is a flowchart illustrating the operation performed by the train-information management device 21. First, the intra-block position calculation unit 1 in the train-in formation management device 21 obtains, by calculation, the train position of the train 20 every n seconds and updates the train position information stored in the current data recording unit 2 (Step S1). The operation of the intra-block position calculation unit 1 will be described in detail. FIG. 6 is a flowchart illustrating the operation for obtaining, by calculation, the train position performed by the train-information management device 21.

First, before starting the calculation to obtain the train position, the calculation unit 11 of the intra-block position calculation unit 1 sets, during the initial state before the start of movement of the train 20, the block number and the intra-block position, and moreover, the calculation unit 11 performs the initial settings, such as settings of the internal variables that are used for obtaining the block number and the intra-block position by calculation (Step S11).

Specifically, when the train-information management device 21 in the train 20 is turned on upon the start of movement of the train 20, the train-information management device 21 reads information stored in the train radio system database in the on-board control device 22 and records it in the train radio system database 7 in the train-information management device 21. If the information already recorded in the train radio system database in the on-board control device 22 and the information recorded in the train radio system database 7 in the train-information management device 21 are the same version, it is not necessary for the train-information management device 21 to perform the above operation and this operation thus can be omitted. Moreover, the running-direction determination unit 3 reads information on the work schedule card under the operation of the driver and notifies the intra-block position calculation unit 1 of the train number. Furthermore, the running-direction determination unit 3 causes the information on the items in the timetable information master table corresponding to the current train number read from the work schedule card to be recorded in the train information database 6.

The calculation unit 11 obtains, using the indicated train number as a key, information on the station name, the platform number information, the stop target kilometrage, and the running direction with respect to the starting station when the train 20 starts moving from the timetable information master table in the train information database 6. The calculation unit 11 assigns the obtained information on the stop target kilometrage to the internal variable for the stop target kilometrage.

The calculation unit 11 obtains, using the obtained station name and platform number information as a key, information on the stop target block number and the stop target intra-block position with respect to the starting station from the station management master table in the train radio system database 7. The calculation unit 11 assigns the obtained information on the stop target block number and the stop target intra-block position to the internal variables for the block number and the intra-block position.

The block-number updating unit 12 records the information on the stop target block number obtained by the calculation unit 11 in the recording area for the block number in the current data recording unit 2. Moreover, the intra-block position updating unit 13 records the information on the stop target intra-block position obtained by the calculation unit 11 in the recording area for the intra-block position and the tail information in the current data recording unit 2. The tail information is information that indicates the position of the end portion of the train 20, which is determined by taking into consideration the length of the train 20 based on the number of cars in the train 20. The tail information is a value that can be changed in consideration of an error due to the movement of the train 20.

The calculation unit 11 records, in the recording area for the train number and the train ID number in the current data recording unit 2, information on the train number and the train ID number in association with the information on the stop target block number and the stop target intra-block position. The train ID number is a unique number for identifying the formation of the train 20 and this number is different from the train number and does not change for each operation. The information on the train ID number that has been recorded in advance in the on-board control device 22 may be used but this is not a limitation.

The calculation unit 11 obtains, using the obtained stop target block number as a key, information on the block length and the next block number for the block in which the starting station is present from the block management master table in the train radio system database 7. The calculation unit 11 assigns the obtained information on the block length and the next block number to the internal variables for the block length and the next block number.

The calculation unit 11 initialises the kilometrage at the time of the previous block switching to zero and initializes the intra-block position at the time of the previous kilometrage resetting to the stop target intra-block position. The kilometrage at the time of the previous block switching is used in the arithmetic expression for obtaining the train position, which will be described later. The kilometrage at the time of the previous block switching is a kilometrage value when the block is switched to the next block. Specifically, the kilometrage at the time of the previous block switching is the kilometrage that indicates the block end point of the block in which the train 20 was present previously and indicates the block start point of the current block. The intra-block position at the time of the previous kilometrage resetting is a value that represents the position at which the kilometrage becomes zero at the stop or the like with the intra-block position. The intra-block position at the time of the previous kilometrage resetting becomes a specific value in the block in which the stop is present and the kilometrage is not continuous and becomes zero in the block in which the stop is not present and the kilometrage is continuous.

The calculation unit 11 obtains tail information by calculation on the basis of the intra-block position at the time of the previous kilometrage resetting and the train length. The intra-block position updating unit 13 records the tail information calculated by the calculation unit 11 in the recording area for the intra-block position and the tail information in the current data recording unit 2. When the calculation unit 11 updates the intra-block position, the calculation unit 11 also updates the tail information. In the following descriptions as well, when the calculation unit 11 updates the intra-block position, the calculation unit 11 calculates tail information as described above.

The calculation unit 11 sets a kilometrage abnormality flag to OFF, which indicates valid. The kilometrage abnormality flag is a flag that is recorded in the current data recording unit 2 and indicates whether information on the intra-block position obtained by calculation is valid or not.

The door opening/closing control unit 4 closes the doors of the train 20 under the operation of the driver or the like and it notifies the intra-block position calculation unit 1 that the doors are closed. The train 20 then departs and starts moving (Step S12).

When the train 20 starts moving, the calculation unit 11 checks whether n seconds have passed (Step S13). The calculation unit 11 waits until n seconds pass (No at Step S13). After n seconds, have passed (Yes at Step S13), the calculation unit 11 calculates the train position (Step S14). Specifically, the calculation unit 11 obtains information on the kilometrage calculated by the kilometrage calculation unit 5 and calculates the intra-block position by using the following equation (1).

$$\text{Intra-block position} = \text{Kilometrage} - \text{Kilometrage at the time of previous block switching} + \text{Intra-block position at the time of previous kilometrage resetting} \quad (1)$$

The calculation unit 11 checks whether the intra-block position obtained by calculation has exceeded the block length of the block assigned to the internal variable. If the intra-block position has exceeded the block length, the calculation unit 11 temporarily stores, in its own next-block-number temporary storage area, the next block number assigned to the internal variable and also temporarily stores, in its own block-length temporary storage area, the block length of the block assigned to the internal variable. The calculation unit 11 obtains, using the next block number as a key, information on the block length and the next block number for the next block from the block management master table in the train radio system database 7. The block next to the next block means the block two blocks after the current block. The calculation unit 11 assigns the obtained information on the block length and the next block number to the internal variables for the block length and the next block number.

The calculation unit 11 obtains the difference between the intra-block position obtained by calculation and the block length of the block before exceeding the block length, i.e., the block length temporarily stored in the block-length temporary storage area. The calculation unit 11 uses the value of the obtained difference as the intra-block position in the current block that is the block next to the block in which the train 20 was present during the previous calculation and is the block in which the train 20 is present during the current calculation, and the calculation unit 11 assigns this intra-block position to the internal variable for the intra-block position.

In general, an error between the value calculated by the kilometrage calculation unit 5 and the actual kilometrage increases as the kilometrage increases and the calculation unit 11 takes this into consideration so as to obtain the value of the train length that is increased by a few meters every defined kilometrage and it updates the tail information.

The calculation unit 11 updates the kilometrage at the time of the previous block switching to the value that is obtained by subtracting the updated intra-block position from the kilometrage. As described above, the kilometrage at the time of the previous block switching is the kilometrage that indicates the block end point of the block in which the train 20 was present previously and indicates the block start point of the current block. Moreover, the calculation unit 11 updates the value of the intra-block position at the time of the previous kilometrage resetting to zero.

The block-number updating unit 12 reads the next block number temporarily stored in the next-block-number temporary storage area in the calculation unit 11 from the calculation unit 11 as the current block number and the block-number updating unit 12 updates the information stored in the recording area for the block number in the current data recording unit 2. Moreover, the intra-block position updating unit 13 updates the information stored in the recording area for the intra-block position and the tail information in the current data recording unit 2 to the information on the intra-block position and the tail information updated by the calculation unit 11 (Step S15).

When the intra-block position obtained by calculation by the calculation unit 11 has not exceeded the block length of the block assigned to the internal variable, the block number is not updated and thus the block-number updating unit 12 does not operate. The intra-block position updating unit 13 updates the information stored in the recording area for the intra-block position and the tail information in the current data recording unit 2 to the information on the intra-block position and the tail information updated by the calculation unit 11 (Step S15).

When the calculation unit 11 calculates the train position, the calculation unit 11 checks whether the kilometrage is to be reset, i.e., whether the train 20 is stopped (Step S16). When the calculation unit 11 has received information indicating that the doors are open from the door opening/closing control unit 4, the calculation unit 11 can determine that the train 20 is stopped. However, this is not a limitation and other methods may also be used. For example, whether the doors are open may be determined by using speed information on the train 20 based on the kilometrage from the kilometrage calculation unit 5.

When the train 20 is stopped (Yes at Step S16), the calculation unit 11 obtains, using the train number as a key, information on the station name and the platform number information for the current stop from the timetable information master table in the train information database 6. Moreover, the calculation unit 11 obtains, using the obtained station name and platform number information as a key, information on the stop target block number and the stop target intra-block position for the current stop from the station management master table in the train radio system database 7.

When the train 20 stops at the current stop, the calculation unit 11 assigns the block number and the intra-block position to the internal variables for the block number and the intra-block position on the basis of the result of comparison between the information on the stop target block number and the stop target intra-block position obtained by collating the station management master table in the train radio system database 7 and the timetable information master table in the train information database 6 with the information on the block number and the intra-block position obtained by calculation in accordance with the information on the kilometrage from the kilometrage calculation unit 5. Specifically, as a result of the comparison, when the values of the block number and the intra-block position obtained by calculation are different from the values of the stop target block number and the stop target intra-block position that are obtained, the calculation unit 11 corrects the block number and the intra-block position obtained by calculation in accordance with the information on the stop target block number and the stop target intra-block position obtained for the current stop (Step S17). At this point in time, in addition to the correction, the calculation unit 11 initializes the kilometrage at the time of the previous block switching to zero and updates the intra-block position at the time of the previous kilometrage resetting to the obtained step target intra-block position.

The calculation unit 11 determines whether the intra-block position obtained by calculation is valid (Step S18). The calculation unit 11 compares the intra-block position before the correction that is obtained by the current train position calculation at Step S14 after the elapse of n seconds, which is described above, and the obtained stop target intra-block position at the current stop. When the difference resulting from the comparison is smaller than or equal to a defined threshold value, the calculation unit 11 determines that the intra-block position obtained by calculation is valid (Yes at Step S18) and sets the kilometrage abnormality flag in the current data recording unit 2 to OFF (Step S19).

The block-number updating unit 12 updates the information stored in the recording area for the block number in the current data recording unit 2 to the information on the stop target block number obtained by the calculation unit 11. Moreover, the intra-block position updating unit 13 updates the information stored in the recording area for the intra-block position and the tail information in the current data recording unit 2 to the information on the stop target intra-block position obtained by the calculation unit 11 and the tail information calculated by the calculation unit 11 (Step S20).

In contrast, when the difference is larger than the defined threshold value as a result of the comparison between the intra-block position obtained by calculation and the obtained stop target intra-block position at the current stop (No at Step S18), the calculation unit 11 determines that the information on the intra-block position obtained by calculation is invalid and sets the kilometrage abnormality flag in the current data recording unit 2 to ON (Step S21).

When the train position is calculated, the calculation unit 11 checks whether the kilometrage is to be reset, i.e., whether the train 20 is stopped. When the train 20 is moving (No at Step S16), the calculation unit 11 omits Steps S17 to S21.

The description returns here to FIG. 5. The on-board router 8 of the train-information management device 21 obtains train position information from the current data recording unit 2 every k seconds and transmits, via the public-radio-network on-board radio station 27 and then over the public radio network 36, the obtained train position information to the train-presence management device every second (Step S2). Specifically, the on-board router 8 obtains, from the current data recording unit 2, information on the block number, the intra-block position, the tail information, the train number, the train ID number, and the kilometrage abnormality flag and transmits it to the train-presence management device 34. The on-board router 8 transmits the same information to the train-presence management device 34 for k seconds.

In the train-information management device 21, the calculation unit 11 calculates and updates the train position in the current data recording unit 2 every n seconds and the on-board router 8 obtains the information stored in the current data recording unit 2 every k seconds and transmits the information. Here, the n-second period represents a first period, the k-second period represents a second period, and the second period is longer than the first period. In other words, k-second period>n-second period is satisfied.

When the kilometrage abnormality flag is ON, the ground side determines that the train position information transmitted from the train 20 contains an unacceptable error and thus does not use this train position information. Consequently, the ground side can avoid the use of train position information that is obtained in the train 20 but has a large error.

Figure 7:
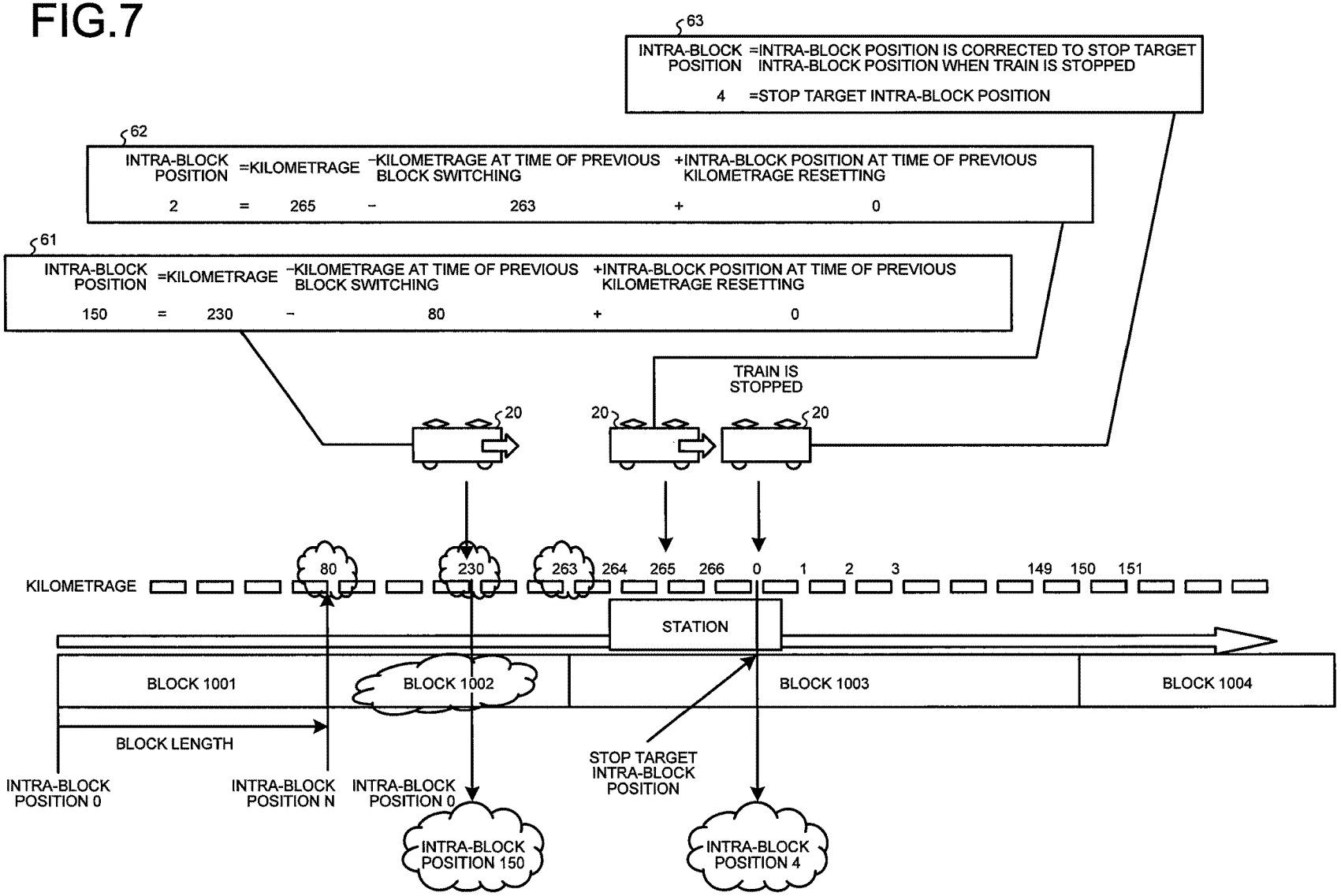
FIG. 7 is a diagram illustrating the details of the calculation processes when a calculation unit updates the block number and the intra-block position of the train.
Figure 8:
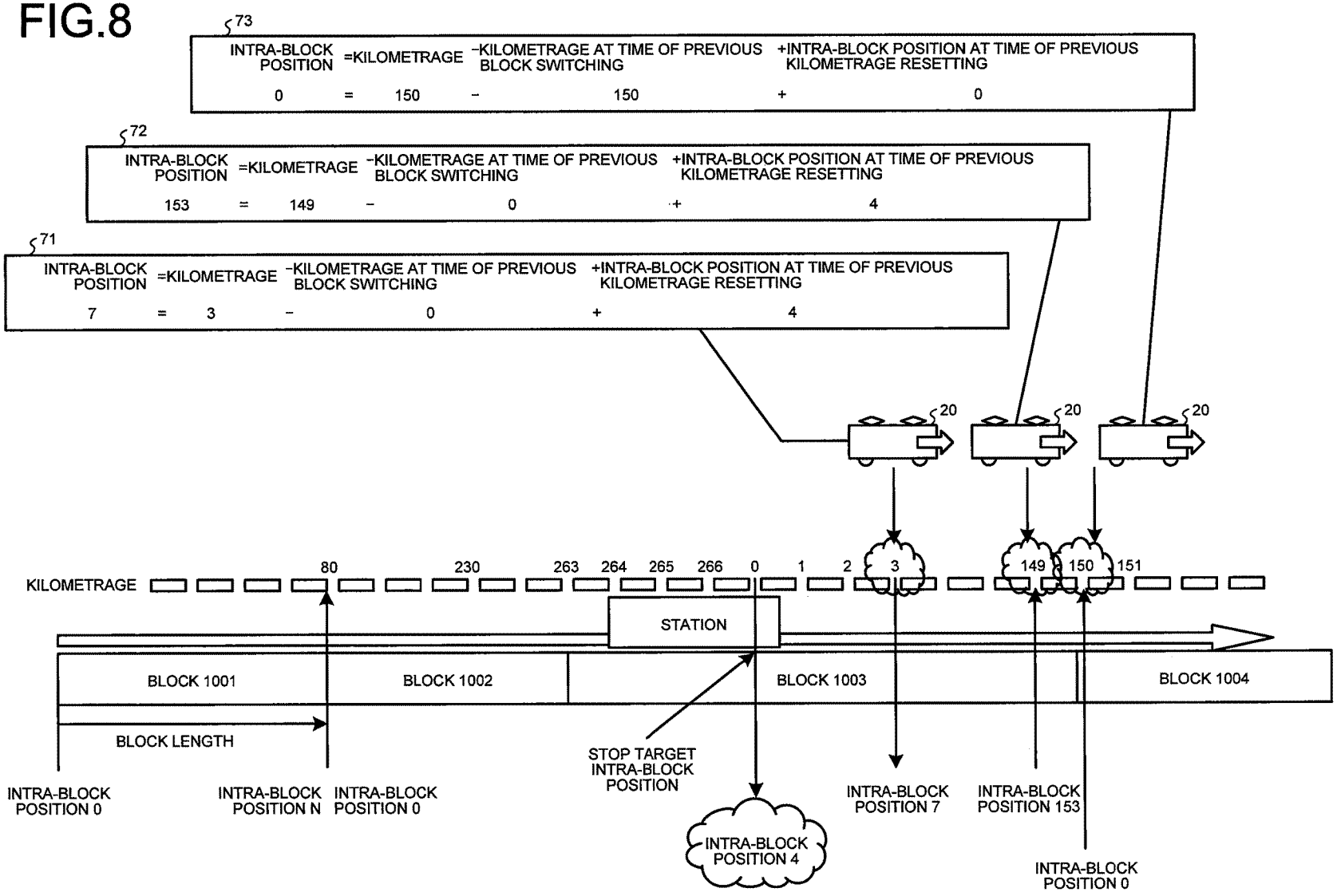
FIG. 8 is a diagram illustrating the details of the calculation processes when the calculation unit updates the block number and the intra-block position of the train.

A description will be given of a specific example of how the calculation unit 11 of the train-information management device 21 performs calculations when the train 20 is running or is stopped. FIG. 7 and FIG. 8 are diagrams illustrating the details of the calculation processes when the calculation unit 11 updates the block number and the intra-block position of the train 20. In FIG. 7 and FIG. 8, the trains 20 with an arrow illustrated thereon are moving.

In FIG. 7, in a calculation process 61, the kilometrage is 230, the kilometrage at the time of the previous block switching is the kilometrage at the end point of a block 1001 and at the start point of a block 1002, i.e., 80, and the intra-block position at the time of the previous kilometrage resetting is 0 because the train 20 is not stopped in the block 1001 and the kilometrage is thus not reset in the block 1001. Consequently, the calculation unit 11 obtains the intra-block position=230−80+0=150 by using the equation (1). The block number at this point in time is 1002.

In a calculation process 62, the kilometrage is 265, the kilometrage at the time of the previous block switching is the kilometrage at the end point of the block 1002 and at the start point of a block 1003, i.e., 263, and the intra-block position at the time of the previous kilometrage resetting is 0 because the train 20 is not stopped in the block 1002 and the kilometrage is thus not reset in the block 1002. Consequently, the calculation unit 11 obtains the intra-block position=265−263+0=2 by using the equation (1). The block number at this point in time is 1003.

In a calculation process 63, because the train 20 is stopped, the calculation unit 11 corrects the intra-block position to the stop target intra-block position. Consequently, the intra-block position becomes the stop target intra-block position, i.e., four.

Moreover, in FIG. 6, in a calculation process 71, the kilometrage is three, the kilometrage at the time of the previous block switching has been initialized to zero, and the intra-block position at the time of the previous kilometrage resecting is the stop target intra-block position at the stop in the block 1003, i.e., four. Consequently, the calculation unit 11 obtains the intra-block position=3−0+4=7 by using the equation (1).

In a calculation process 72, the kilometrage is 149, the kilometrage at the time of the previous block switching has been initialized to 0, and the intra-block position at the time of the previous kilometrage resetting is the stop target intra-block position at the stop in the block 1003, i.e., 4. Consequently, the calculation unit 11 obtains the intra-block position=149−0+4=153 by using the equation (1).

In a calculation process 73, the kilometrage is 150, the kilometrage at the time of the previous block switching is the current kilometrage, i.e., 150, because it has exceeded the block length of the current block 1003, and the intra-block position at the time of the previous kilometrage resetting is initialised to 0 because it has exceeded the block 1003. Consequently, the calculation unit 11 obtains the intra-block position=150−150+0=0 by using the equation (1). The block number at this point in time is 1004.

In such, a manner, the intra-block position calculation unit 1 obtains position information on the train 20 independently from the on-board control device 22 and transmits the train position information to the train-presence management device 34 along a route that goes through the public radio network 36 but does not go through the train control radio base station 31. Consequently, even when the train control on-board radio station 26, the on-board control device 22, or the like of the train radio system as well as its redundant system fail or even when the train control radio base station 31 as well as its redundant system fail, the train 20 can still transmit train position information to the ground side. The train position information to be transmitted from the train 20 over the public radio network 36 can, for example, be used as a backup in a case when a device in the train radio system fails. In such a case, it is not necessary to dispose the ID pickup coil 23 on the train 20 and the ID detection ground coils 38 on the ground side; therefore, the train 20 in the train radio system with a simple configuration can transmit the train position information to the ground side.

The train-information management device 21 can be used as a backup device for transmitting train position information to the ground side from the train 20 in the train radio system; however, the train-information management device 21 can also be used for other purposes.

Moreover, the train-information management device 21 always transmits train position information to the ground side; however, this is not a limitation. The train 20 may have a configuration with which a failure in a device in the train radio system is detected and the train-information management device 21 may start transmitting train position information after the detection of a failure of the device in the train radio system. Moreover, when the train-information management device 21 receives, from the ground side and via the public-radio-network on-board radio station 27, a notification that indicates that train position information cannot be received from the train 20 through the normal route of the train radio system, the train-information management device 21 may start transmitting train position information after the receipt of the notification.

Furthermore, when the train-information management device 21 receives, over the public radio network 36 and then via the public-radio-network on-board radio station 27, a correction instruction from the ground side, the train-information management device 21 may correct the block number and the intra-block position obtained by calculation on the basis of the correction instruction. Information on the correction may be a value indicated from the ground side or may be information contained in the train radio system database 7. Consequently, when the position, of the train 20 has been specified on the ground side, the train 20 can correct the block number and the intra-block position obtained by calculation regardless of the calculation result.

Moreover, although the train-information management device 21 transmits, via the public-radio-network on-board radio station 27 and then over the public radio network 36, information to the train-presence management device 34, this is not a limitation and any communication network may be used instead of the public radio network 36 as long as the route does not go through the train control radio base station 31.

Figure 9:
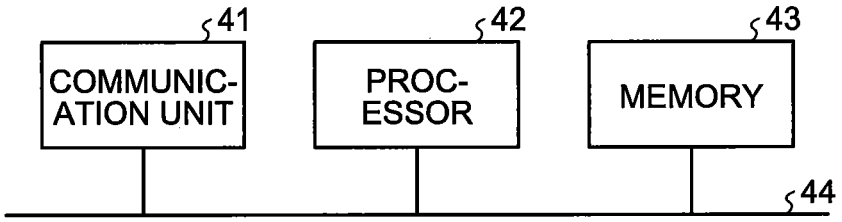
FIG. 9 is a diagram illustrating a hardware configuration of the train-information management device.

Here, a description will be given of a hardware configuration that implements each component in the block diagram of the train-information management device 21 illustrated in FIG. 2. FIG. 9 is a diagram illustrating a hardware configuration of the train-information management device 21. A processor 42 executes the program stored in a memory 43 so as to implement the intra-block position calculation unit 1, the running-direction determination unit 3, the door opening/closing control unit and the kilometrage calculation unit 5. The current data recording unit 2, the train information database 6, and the train radio system database 7 are implemented by the memory 43. The on-board router 8 is implemented by a communication unit 41. The communication unit 41, the processor 42, and the memory 43 are connected with each other by a system bus 44. In the train-information management device 21, the functions of the respective components illustrated in the block diagram in FIG. 2 may be implemented by a plurality of processors 42 and a plurality of memories 43 cooperating with each other. Although the train-information management device 21 can be implemented by using the hardware configuration illustrated in FIG. 9, it can be implemented by either software or hardware.

As described above, according to the present embodiment, in the train-information management device 21 of the train 20, the intra-block position calculation unit 1 performs a calculation to convert information on the kilometrage that indicates the position of the train 20 into information in the form of the block number and the intra-block position so as to obtain the train position and records the train position in the current data recording unit 2; and the on-board router 8 obtains train position information on the train 20 from the current data recording unit 2 and communicates the train position information to the train-presence management device 34 by using a communication system that is different from that used for communication via the train control radio base station 31 in the train radio system. Consequently, in the train 20, even when the on-board control device 22, the train control on-board radio station 26, the train control radio base station 31, or the like in the train radio system fails, the train position can still be determined by a calculation performed only by the intra-block position calculation unit 1 and thus train position information can be transmitted to the ground side. Moreover, it is not necessary to provide the train 20 with the ID pickup coil 23 and provide the ground side with the ID detection ground coils 38; therefore, the train position can be obtained using a simple configuration. Moreover, in the present embodiment, because the train position can be uniquely specified by using the block number and the intra-block position, the train position can be specified with higher accuracy than when the train position is specified by using kilometrage.

The configuration illustrated in the above embodiment is an example of the content of the present invention and can be combined with other publicly known technologies, and part of the configuration can be removed or modified without departing from the scope of the present invention.

REFERENCE SIGNS LIST

1 intra-block position calculation unit, 2 current data recording unit, 3 running-direction determination unit, 4 door opening/closing control unit, 5 kilometrage calculation unit, 6 train information database, 7 train radio system database, 8 on-board router, 11 calculation unit, 12 block-number updating unit, 13 intra-block position updating unit, 20 train, 21 train-information management device, 41 communication unit, 42 processor, 43 memory, 44 system bus.

The invention claimed is:

1. A train-information management device mounted on a train, the train-information management device comprising:

an intra-block position calculator to convert information on a kilometrage that indicates a position of the train into information on a block number and an intra-block position of a plurality of blocks into which a route of the train is divided and that are used when a train position is specified by a train radio system; and a communication device to communicate the information on the block number and the intra-block position to a ground side by using a system that is different from a system that is used for communication between the ground side and a train side via a radio base station in the train radio system.

2. The train-information management device according to claim 1, wherein the intra-block position calculator converts the information on the kilometrage into the information on the block number and the intra-block position by using information on a train number that is a number for identifying the train that is running, information on a running direction of the train, information on a stop of the train and a number of a platform that is used by the train, information on a stop target block number and a stop target intra-block position that indicate a position of the stop, and information on a block length and a next block for each of the blocks.

3. The train-information management device according to claim 2, wherein, when the train stops at a station, the intra-block position calculator corrects the intra-block position by using the information on the stop target intra-block position.

4. The train-information management device according to claim 3, wherein the intra-block position calculator sets, when a difference between the stop target intra-block position and the intra-block position is larger than a defined threshold value, a flag that indicates that the difference is larger than the threshold value and sets, when the difference is smaller than or equal to the threshold value, a flag that indicates that the difference is smaller than or equal to the threshold value, and the communication device transmits, to the ground side, information on a set flag together with the information on the block number and the intra-block position.

5. The train-information management device according to claim 3, wherein the intra-block position calculator corrects the block number and the intra-block position on a basis of an instruction from the ground side.

6. The train-information management device according to claim 1, wherein the intra-block position calculator converts the information on the kilometrage into the information on the block number and the intra-block position of the blocks every first period, and the communication device transmits the information on the block number and the intra-block position every second period, the second period being longer than the first period.

7. A train-information management method comprising:

converting information on a kilometrage that indicates a position of a train into information on a block number and an intra-block position of a plurality of blocks into which a route of the train is divided and that are used when a train position is specified by a train radio system; and communicating the information on the block number and the intra-block position to a ground side by using a system that is different from a system that is used for communication between the ground side and a train side via a radio base station in the train radio system.

8. The train-information management method according to claim 7, wherein the converting includes converting the information on the kilometrage into the information on the block number and the intra-block position by using information on a train number that is a number for identifying the train that is running, information on a running direction of the train, information on a stop of the train and a number of a platform that is used by the train, information on a stop target block number and a stop target intra-block position that indicate a position of the stop, and information on a block length and a next block for each of the blocks.

9. The train-information management method according to claim 8, further comprising correcting the intra-block position by using the information on the stop target intra-block position when the train stops at a station.

10. The train-information management method according to claim 9, wherein the correcting includes setting a flag that indicates that a difference between the stop target intra-block position and the intra-block position is larger than a defined threshold value when the difference is larger than the threshold value, and setting a flag that indicates that the difference is smaller than or equal to the threshold value when the difference is smaller than or equal to the threshold value, and the communicating includes transmitting information on a set flag to the ground side together with the information on the block number and the intra-block position.

11. The train-information management method according to claim 9, wherein the correcting includes correcting the block number and the intra-block position on a basis of an instruction from the ground side.

12. The train-information management method according to claim 7, wherein the converting includes converting the information on the kilometrage into the information on the block number and the intra-block position of the blocks every first period, and the communicating includes transmitting the information on the block number and the intra-block position every second period, the second period being longer than the first period.

* * * * *